US010697679B2

(12) United States Patent
Aschan et al.

(10) Patent No.: US 10,697,679 B2
(45) Date of Patent: Jun. 30, 2020

(54) COOLING SYSTEM AND A METHOD FOR CONTROL THEREOF

(71) Applicant: Electrolux Appliances Aktiebolag, Stockholm (SE)

(72) Inventors: Andreas Aschan, Stockholm (SE); Richard Furberg, Stockholm (SE); Trung Pham Viet, Stockholm (SE)

(73) Assignee: ELECTROLUX APPLIANCES AKTIEBOLAG, Stockholm (SE)

( * ) Notice: Subject to any disclaimer, the term of this patent is extended or adjusted under 35 U.S.C. 154(b) by 22 days.

(21) Appl. No.: 15/580,138

(22) PCT Filed: Jun. 8, 2015

(86) PCT No.: PCT/EP2015/062633
§ 371 (c)(1),
(2) Date: Dec. 6, 2017

(87) PCT Pub. No.: WO2016/198084
PCT Pub. Date: Dec. 15, 2016

(65) Prior Publication Data

US 2018/0142930 A1 May 24, 2018

(51) Int. Cl.
*F25B 49/02* (2006.01)
*F25B 5/02* (2006.01)
*F25B 41/04* (2006.01)

(52) U.S. Cl.
CPC ..... *F25B 49/02* (2013.01); *F25B 5/02* (2013.01); *F25B 41/04* (2013.01);
(Continued)

(58) Field of Classification Search
CPC ..... F25B 41/04; F25B 49/02; F25B 2500/26; F25B 2500/27; F25B 2500/28;
(Continued)

(56) References Cited

U.S. PATENT DOCUMENTS 5,630,323 A * 5/1997 Niijima ..... F25B 41/04 62/158
8,161,763 B2 4/2012 Yun et al.
(Continued)

FOREIGN PATENT DOCUMENTS

CN 1123398 A 5/1996
CN 101317050 A 12/2008
(Continued)

OTHER PUBLICATIONS

International Search Report and Written Opinion for International Application No. PCT/EP2015/062633, dated Apr. 18, 2016—12 Pages.
(Continued)

*Primary Examiner* — Marc E Norman
(74) *Attorney, Agent, or Firm* — RatnerPrestia

(57) ABSTRACT

A refrigerator apparatus having a compressor, a condenser, an evaporator, and a valve interconnected in the flow from the condenser to the evaporator. The valve is operatively controlled to a first, open, state and to a second, closed, state by a controller. The controller is configured to the valve to operate in accordance with at least one of: opening the valve a time period of 0-180 seconds before the compressor is switched to an on-phase; and closing the valve before the compressor is switched to an off-phase.

10 Claims, 5 Drawing Sheets

(52) U.S. Cl.
CPC ..... *F25B 2500/26* (2013.01); *F25B 2500/27* (2013.01); *F25B 2600/23* (2013.01); *F25B 2600/2511* (2013.01); *F25B 2600/2513* (2013.01)

(58) Field of Classification Search
CPC ..... F25B 2600/23; F25B 2600/2511; F25B 2600/2513; F25B 5/02
See application file for complete search history.

(56) References Cited

U.S. PATENT DOCUMENTS

| | | | | |
|---|---|---|---|---|
| 8,601,831 | B2 | 12/2013 | Fotiadis et al. | |
| 2009/0038323 | A1 | 2/2009 | Guffler et al. | |
| 2012/0272674 | A1* | 11/2012 | Lim | F25D 29/00 62/218 |
| 2013/0213066 | A1 | 8/2013 | Litch et al. | |
| 2014/0318161 | A1 | 10/2014 | Furberg et al. | |

FOREIGN PATENT DOCUMENTS

| | | | |
|---|---|---|---|
| DE | 102006040380 | A1 | 3/2008 |
| DE | 102013010672 | A1 | 12/2014 |

OTHER PUBLICATIONS

Chinese Office Action for Chinese Application No. 2015800807047, dated Sep. 4, 2019 with translation, 19 pages.

* cited by examiner

COOLING SYSTEM AND A METHOD FOR CONTROL THEREOF

This application is a U.S. National Phase application of PCT International Application No. PCT/EP2015/062633, filed Jun. 8, 2015, which is incorporated by reference herein.

TECHNICAL FIELD

The present disclosure relates to a cooling system and a method for control thereof. In particular the present disclosure relates to a cooling system having a valve that can be closed on the path between a condenser and an evaporator of the cooling system.

BACKGROUND

Most compressor cooling systems used in today's household refrigerators use a capillary tube to reduce the pressure of the refrigerant flowing from condenser to evaporator. Further, many of these cooling systems do not run continuously, but turn on and off in cycles. There is then a compressor on-phase followed by a compressor off-phase. In these systems there are typically two kinds of efficiency losses.

Efficiency losses related to refrigerant vapor that flow from condenser to evaporator, through the capillary tube during the compressor off-phase. Since nothing stops the vapor from flowing through the capillary tube during compressor off time, this will happen until the pressures are equalized.

Efficiency losses related to that the evaporator and condenser pressures vary during the compressor on-phase. The refrigerant mass flow rate through the capillary tube is a function of evaporator and condenser pressure. When the pressure difference between evaporator and condenser is high the flow rate is high, and vice versa. This means, unfortunately, that the mass flow rate through the capillary tube does not always correspond to the flow rate that would be optimum for the system. At the start of the compressor on-phase, the pressure difference is lower than at the end of the compressor on phase. This means that the refrigerant flow rate through the capillary tube is lower at the start than at the end of the compressor on-phase. Unfortunately, the flow rate through the capillary tube that would be optimum for the system, vary in the opposite way. In other words, it would typically be better with a higher flow rate at the start than at the end of the compressor on-phase.

To decrease losses resulting from migration of refrigerant during compressor off-phase, an open/close valve can be installed in series with the capillary tube, to stop the refrigerant flow through capillary tube during the time that the compressor is in the off-phase, i.e. when the compressor is not running. In such a system a refrigeration system may use an open/close valve located on the path from the condenser to the evaporator to prevent refrigerant migration from the condenser to the evaporator of the refrigeration system during a compressor off-phase. The valve is set to a closed state during the compressor off-phase and set to an open state during the compressor on-phase. Hereby energy loss resulting from refrigerant migration can be eliminated or at least reduced.

A refrigeration/freezer system as described above is depicted in FIG. 1. Further, in some refrigeration systems, the use of a valve that is in a closed state during a compressor off period results in that the compressor will have to start against a pressure difference between the condenser and evaporator. In order to reduce the need for an increased start torque the valve can be opened a predetermined period before the start of the compressor. This can equalize the pressure difference and may thereby reduce the required start torque. Such a refrigeration system is described in the U.S. Pat. No. 8,161,763.

There is a constant desire to improve the performance in a refrigerant system and to provide more efficient refrigeration system. Hence, there is a need for an improved refrigerator apparatus and to a cooling system used in a refrigerator.

SUMMARY

It is an object of the present invention to provide an improved refrigerator apparatus.

This object and/or others are obtained by the cooling system, the refrigerator/freezer and method as set out in the appended claims.

As has been realized by the inventors, by opening the valve in the path between the condenser and evaporator a small time period before the compressor on-phase and or closing the valve a small time period before the compressor off-phase it is possible to achieve an increased fluid mass flow during the first part of the compressor on-phase and a decreased fluid mass flow during the last part of the compressor on-phase. Hereby energy can be saved in that the mass flow is better fitted to the optimal working conditions of the capillary tube. Energy savings can be expected to be higher in products that run with short compressor cycle times, and in products with large thermal mass evaporators and condensers.

In cooling systems with multiple evaporators and where the refrigerant is only allowed to circulate through one evaporator at the time (or in no evaporator) the energy savings can be expected to be higher. Such a system can for example be used in a combined freezer refrigerator where one evaporator is arranged for the freezer cabinet and one evaporator is arranged for the refrigerator cabinet and where the different evaporators are arranged in parallel. This is because in cooling systems with parallel evaporators, the refrigerator evaporator is typically totally empty on refrigerant after running the freezer evaporator, and vice versa. In such a scenario, an opening of the valve before the compressor starts, is expected to significantly improve efficiency of the evaporator during the first part of the on-phase of the compressor cycle.

To achieve a high energy saving, a correct setting of the time period that the opening/closing of the valve is off-set in relation to the starting stopping of the compressor is important. This is particularly true for the starting of the compressor. Thus, as has been realized by the inventors, if the valve is opened before the compressor is started and the time period is long enough for the pressure to become essentially equal in the condenser and the evaporator as for example described in U.S. Pat. No. 8,161,763, there will be a significant loss of energy because refrigerant in vapor phase will be allowed to migrate from the (warm) condenser to the (cool) evaporator in order to equalize or at least significantly reduce the pressure that the compressor will have to start against. This will be particularly inefficient in cooling system with short compressor cycles, where the frequency of compressor starts and stops is high.

In accordance with one embodiment a cooling system comprising a compressor, a condenser and an evaporator wherein a refrigerant is circulated is provided. The cooling system further comprises a valve interconnected in the flow of the refrigerant from the condenser to the evaporator. The valve is operatively controlled to a first, open, state when the compressor is in an on-phase and to a second, closed, state when the compressor is in an off state by a controller. The controller is adapted to control the valve to operate in accordance with at least one of:

opening the valve a time period of 0-180 seconds before the compressor is switched to an on-phase; and closing the valve before the compressor is switched to an off-phase. Hereby it is obtained that the cyclic energy losses can be reduced.

In accordance with some embodiments, when the controller is adapted to open the valve before the compressor is switched to an on-phase, the time period is set to 5-120 seconds before the compressor is switched to an on-phase. In particular, the time period is set to 10-80 seconds before the compressor is switched to an on-phase.

In accordance with some embodiments, when the controller is adapted to open the valve before the compressor is switched to an on-phase, the time period is set to a time corresponding to a time required for all liquid refrigerant to flow from the condenser to the evaporator before the compressor is switched to an on-phase.

In accordance with some embodiments, when the controller is adapted to close the valve before the compressor is switched to an off-phase, the time period is set to 10-60 seconds before the compressor is switched to an off-phase.

In accordance with some embodiments, the cooling system is provided with at least two evaporators connected in parallel. The valve can then be adapted to either be closed or being open to allow a flow of refrigerant to only one of the parallel evaporators. The controller can then further be adapted to control the valve and the compressor to perform a sequence of compressor cycles wherein the valve is controlled to directing the flow of refrigerant to the same evaporator for at least two consecutive compressor on-phases. In such a configuration with consecutive compressor on-phases with refrigerant flowing through the same evaporator, the waiting time period can be set shorter for the last of said at least two consecutive compressor on-phases than for the first of said at least two consecutive compressor on-phases.

The invention also extends to a method for controlling a cooling system in accordance with the above and to a refrigerator/freezer comprising a cooling system in accordance with the above.

BRIEF DESCRIPTION OF THE DRAWINGS

The present invention will now be described in more detail by way of non-limiting examples and with reference to the accompanying drawings, in which.

DETAILED DESCRIPTION

Figure 1:
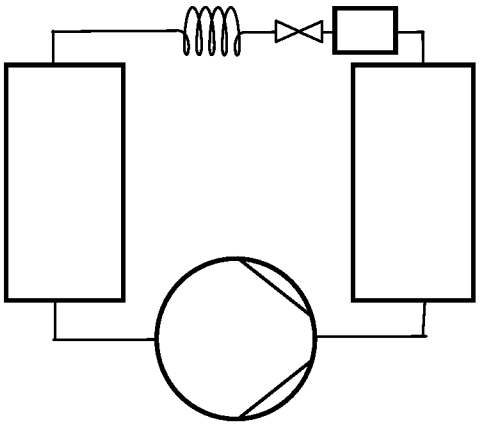
FIG. 1 illustrates a conventional refrigerator system.
Figure 2A:
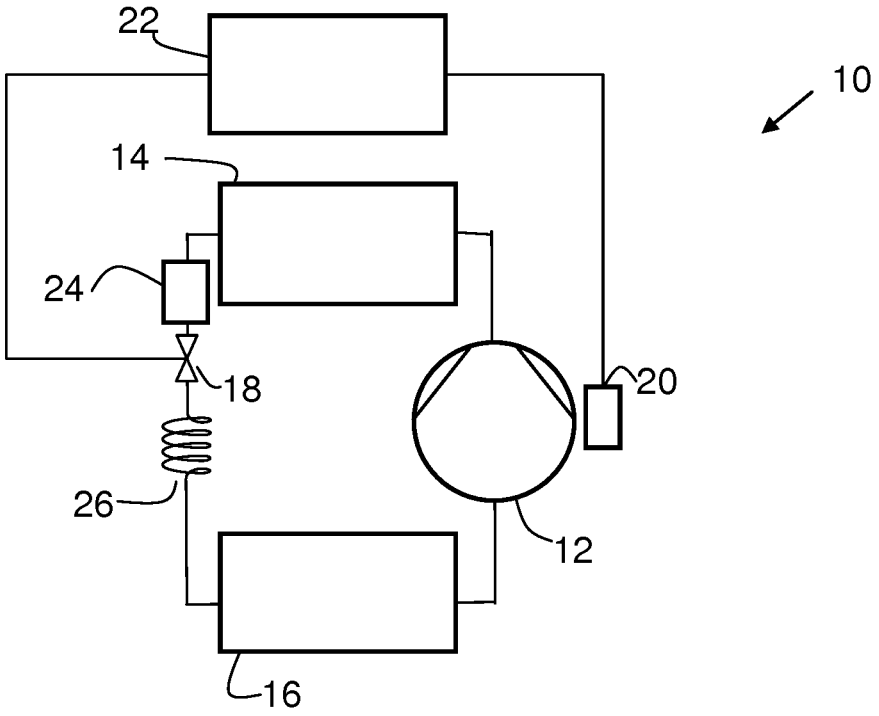
FIGS. 2*a* and 2*b* illustrate different cooling system configurations of a refrigerator apparatus or a similar device.

In FIG. 2*a*, a cooling system 10 for a refrigerator apparatus is illustrated. The refrigerator apparatus can be any cooling device. In particular the refrigerator apparatus can be a refrigerator or a freezer or a combined refrigerator/freezer. The cooling system 10 comprises a compressor 12, a condenser 14 and an evaporator 16. The cooling system 10 also comprises a valve 18, a switch 20 and a controller 22. The cooling system 10 also comprises a capillary tube 26 (or a similar device such as an expansion valve). The cooling system 10 may typically also comprise a filter 24 and may also comprise other components not shown in FIG. 2*a*.

The compressor 12 drives a refrigerant in a cycle whereby the condenser 14 becomes hot and the evaporator 16 becomes cold. In order to reduce energy loss that can occur when the compressor is turned off as a result of hot refrigerant migrating from the hot condenser to the cold evaporator the valve 18 can be provided in the path from the condenser 14 to the evaporator 16. The valve 18 operates to be closed when the compressor is in an off-phase thereby preventing the refrigerant from migrating from the condenser to the evaporator. When the compressor is in an on-phase the valve is open thereby allowing the refrigerant to circulate in the refrigerator system 10. The opening and closing of the valve 18 can be controlled by the controller 22. The controller 22 can also be adapted to control an ON/OFF switch 20 of the compressor 12 whereby the compressor 12 is turned on and off.

Figure 2B:
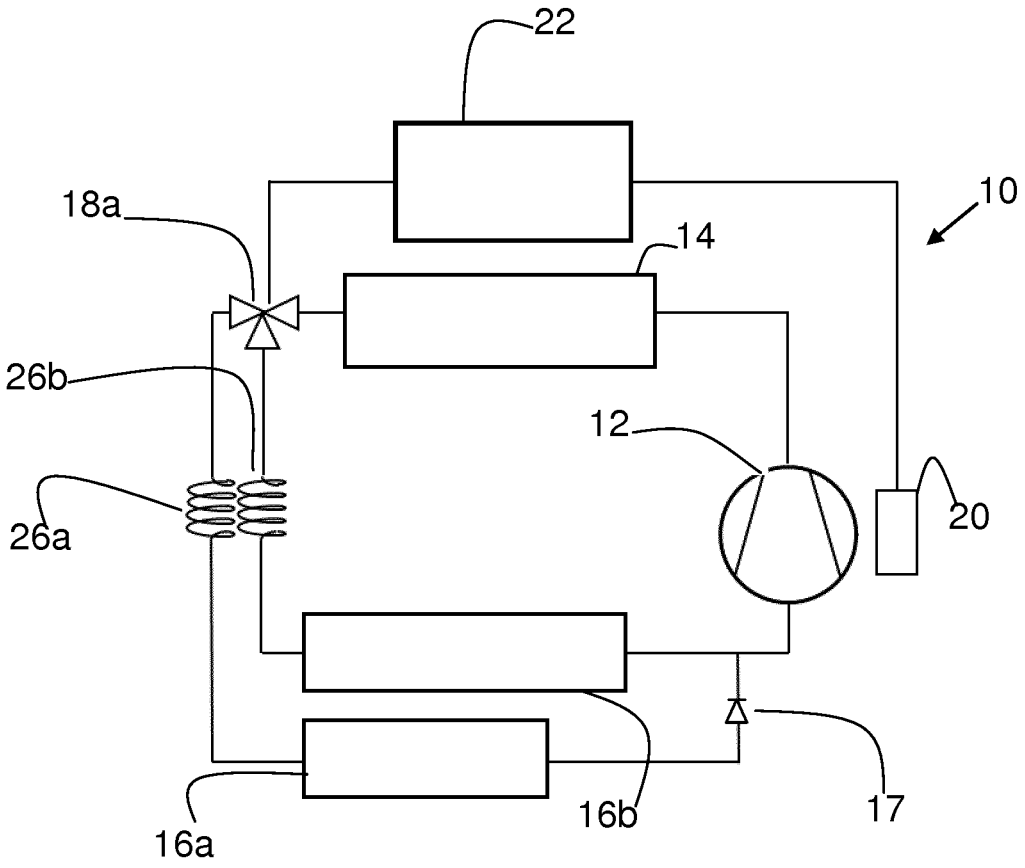

In FIG. 2*b* another configuration of a cooling system is depicted. The cooling system depicted in FIG. 2*b* essentially comprises the same components as the cooling circuit in FIG. 2*a*, and references to such identical components are omitted. The cooling system in FIG. 2*b* comprises two evaporators 16*a* and 16*b* provided in parallel. The controller is here configured to either close the valve or open the valve such that the refrigerant circulated in the cooling circuit circulates through only one of the evaporators 16*a* or 16*b*. The evaporator 16*a* can for example be an evaporator for cooling the refrigerator cabinet of a combined refrigerator/freezer and the evaporator 16*b* can for example be an evaporator for cooling the freezer cabinet of a combined refrigerator/freezer. This is obtained by controlling a three-way valve 18*a*, that can be set in a closed position, an open position allowing the refrigerant to circulate through the evaporator 16*a* or an open position allowing the refrigerant to circulate through the evaporator 16*b*. Each of the evaporators 16*a* and 16*b* is associated with a respective capillary tube 26*a* and 26*b*, respectively. The capillary tubes 26*a* and 26*b* are arranged in series with the respective evaporators 16*a* and 16*b* downstream the valve 18*a*. A one-way valve 17 can further be provided downstream of the evaporator 16*b*.

Figure 3:
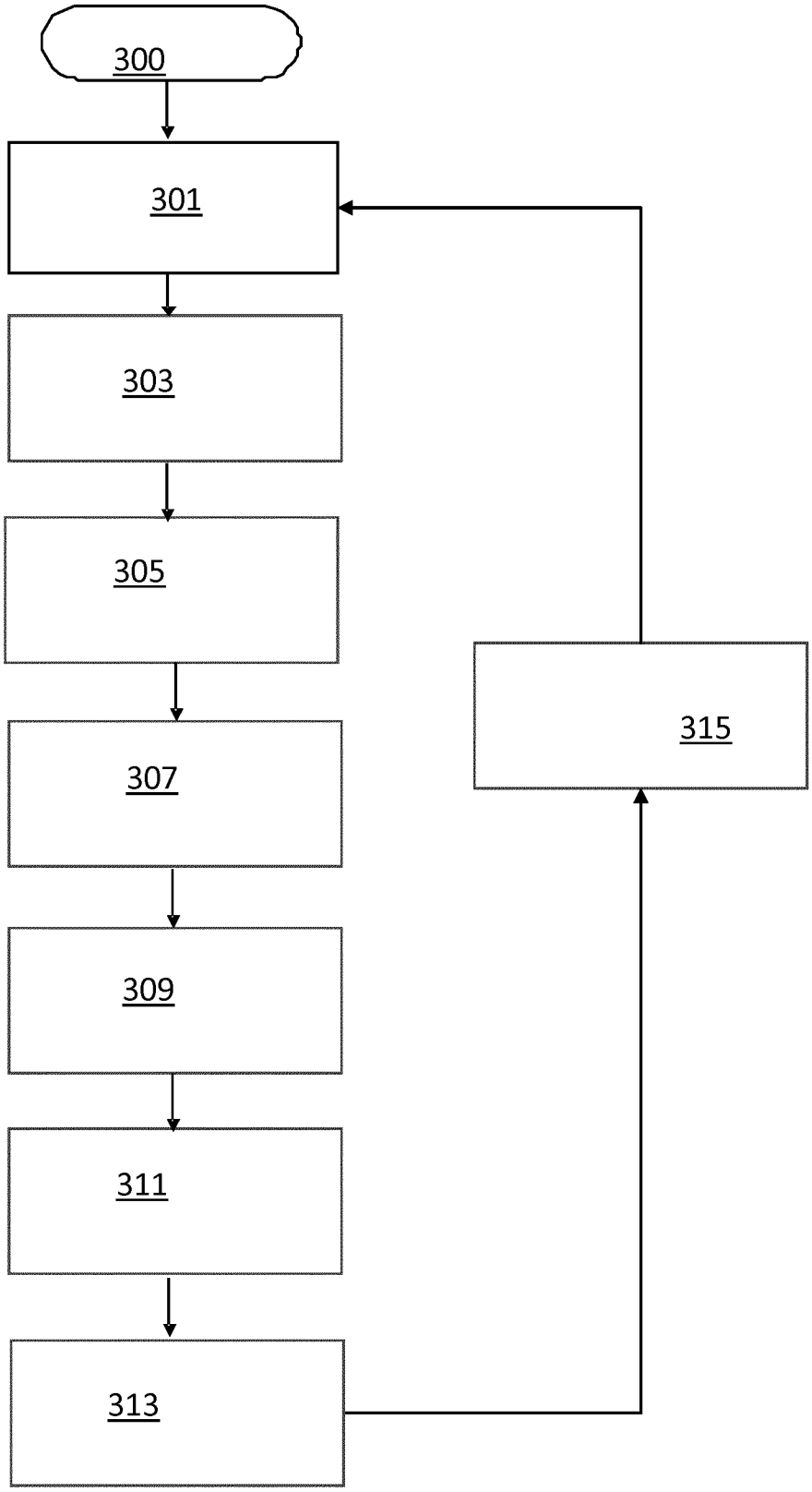
FIG. 3 is a flow chart illustrating some steps performed when controlling a cooling system.

In FIG. 3 an exemplary control procedure for controlling the valve 18 (or 18*a*) to an open or closed state are depicted. First, the procedure starts in a step 300. In the start step 300, the compressor 12 is switched off and the valve 18 is closed. Next in a step 301, the valve 18 is opened to prepare for a compressor start. After the valve 18 is opened in step 301, a time period is waited in a step 303. The time period in 303 can in accordance with some embodiments be pre-set and stored in the controller 22. The time period waited in step 303 can be timed by an internal timer of the controller 22. The time period in step 303 can be set to minimize energy losses resulting from non-optimal fluid mass flow through the capillary tube 26. In some embodiments the valve 18 is opened 0-180 seconds before the compressor 12 is started. In some embodiments the valve 18 is opened 5-120 seconds before the compressor 12 is started. In some embodiments the valve 18 is opened 10-80 seconds before the compressor 12 is started. In some embodiments the time period is set to the time corresponding to the time it takes for the liquid refrigerant in the condenser to leave the condenser. In other words the time period is set to correspond to the time it takes until gas starts to migrate from the condenser to the evaporator.

Next, in a step 305, the compressor 12 is started. The compressor 12 then runs for the duration of the compressor on-phase in a step 307. Before the compressor is switched off the valve 18 is closed in a step 309. Then there is a waiting period from when the valve 18 is closed until the compressor is switched off in a step 311. The waiting time in step 311 can in some embodiments be 0-60 seconds. In some embodiments the waiting time in step 311 is 5-50 seconds. In some embodiments the waiting time in step 311 is 10-40 seconds. Then, in a step 313, the compressor is switched off. The compressor is then in an off-phase in a step 315, which completes the compressor cycle. A new compressor cycle can then start by returning to step 301.

In the exemplary procedure above the controller 22 is configured to use both a time off-set, i.e. a waiting time period, between the opening of the valve 18 and the start of the compressor 12 as well as a time offset, i.e. a waiting time period, between the closing of the valve 18 and the stop of the compressor 12. However it is envisaged that in some embodiments one of the time off-sets is set to 0 seconds such that there will only be a time off-set, a waiting time period in which the valve is opened/closed before starting or stopping the compressor.

Also, it is envisaged that the time off-set can be different for different compressor cycles. For example if the cooling system is a system with parallel evaporators as depicted in FIG. 2*b*. The controller can be configured to run a sequence of compressor cycles with different time offsets in the different compressor cycles. For example the controller can be configured to run a sequence of two or three or more compressor cycles where the refrigerant is circulated through the refrigerator evaporator followed by a compressor cycle where the refrigerant is circulated through the freezer evaporator (this pattern can then be repeated in a next sequence). In each of the compressor cycles of such a sequence of compressor cycles a particular setting to the respective waiting time periods can be configured and employed.

For example in a first compressor cycle the refrigerant is circulated through the refrigerator evaporator, the valve is then opened 80 seconds before the compressor is switched on and the valve is closed 20 seconds before the compressor is switched off. In a second compressor cycle the refrigerant is circulated through the refrigerator evaporator, the valve is then opened 70 seconds before the compressor is switched on and the valve is closed 20 seconds before the compressor is switched off. In a third compressor cycle the refrigerant is circulated through the refrigerator evaporator, the valve is then opened 70 seconds before the compressor is switched on and the valve is closed 0 seconds before the compressor is switched off. In a forth compressor cycle the refrigerant is circulated through the freezer evaporator, the valve is then opened 60 seconds before the compressor is switched on.

Other compressor cycle sequences and other settings of the respective waiting time periods can be employed depending on the specific need for a particular application. In some embodiments the waiting time periods are set longer in the beginning in such a sequence of compressor cycles. Thus, when the controller initiates a sequence of compressor cycles the waiting time periods can be longer for the first compressor cycle than for the last compressor cycle in such a sequence of compressor cycles.

Figure 4:
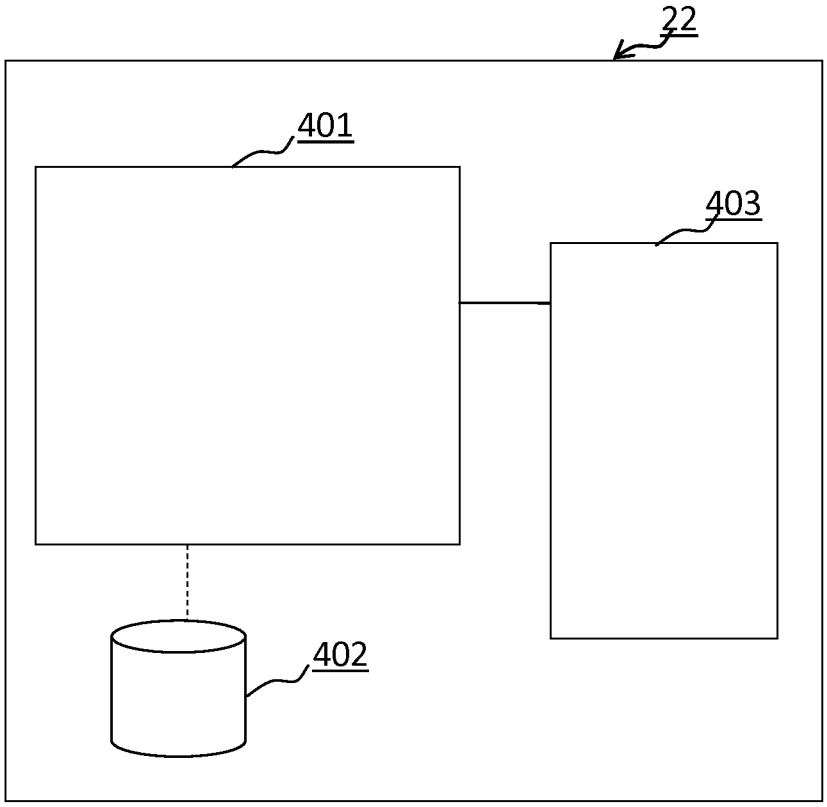
FIG. 4 illustrates a controller.

Further, the controller 22 can be implemented using suitable hardware and or software. An exemplary controller is depicted in FIG. 4. The hardware can comprise one or many processors 401 that can be arranged to execute software stored in a readable storage media 402. The processor(s) can be implemented by a single dedicated processor, by a single shared processor, or by a plurality of individual processors, some of which may be shared or distributed. Moreover, a processor or may include, without limitation, digital signal processor (DSP) hardware, ASIC hardware, read only memory (ROM), random access memory (RAM), and/or other storage media. The processor 22 is adapted to send and receive signals from other entities such as the switch 20 and the valve 18 using an interface 403. The controller 22 can in particular be configured to implement the control procedures as described herein.

Using the methods and apparatuses as set out herein provides a more efficient refrigerator system that can be used in a freezer/refrigerator.

The invention claimed is:

1. A cooling system comprising:

a compressor;

a condenser;

an evaporator system comprising a first evaporator configured to cool a refrigerator cabinet and a second evaporator configured to cool a freezer cabinet, the first evaporator and the second evaporator being fluidly connected in parallel to the compressor and condenser, the evaporator system, compressor and condenser being configured to contain a refrigerant for circulation therethrough;

a valve fluidly interconnected between the condenser and the evaporator system; and a controller operatively connected to the valve and the compressor, and wherein the controller is adapted to control the valve and the compressor to perform a sequence of compressor cycles including:

a refrigerator cabinet cooling cycle comprising:

moving the valve to a first open state in which the condenser is fluidly connected to the first evaporator, after a first time period of 10-80 seconds, switching the compressor on, and, after a second time period, switching the compressor off and moving the valve to a closed state; and a freezer cabinet cooling cycle, performed after the refrigerator cabinet cooling cycle, and comprising:

moving the valve to a second open state in which the condenser is fluidly connected to the second evaporator, after a third time period, switching the compressor on, and after a fourth time period, switching the compressor off and moving the valve to the closed state.

2. The cooling system according to claim 1, wherein the first time period is set to a time corresponding to a time required for all liquid refrigerant to flow from the condenser to the first evaporator.

3. The cooling system according to claim 1, wherein the second time period is 10-60 seconds.

4. The cooling system according to claim 1, wherein the controller is adapted to control the valve and the compressor to perform the refrigerator cabinet cooling cycle at least two consecutive times before performing the freezer cabinet cooling cycle.

5. The cooling system according to claim 4, wherein the first time period is shorter for a last of the at least two consecutive refrigerator cabinet cooling cycles than for a first of the at least two consecutive refrigerator cabinet cooling cycles.

6. The cooling system according to claim 1, further comprising a refrigerant contained within the compressor, condenser and evaporator system.

7. The cooling system of claim 1, wherein, during the refrigerator cabinet cooling cycle, the controller is adapted to switch the valve to the closed state before switching the compressor off.

8. A method for controlling a cooling system comprising a compressor, a condenser, a first evaporator configured to cool a refrigerator cabinet, a second evaporator configured to cool a freezer cabinet, and a refrigerant contained for circulation within the cooling system, the cooling system further comprising a valve interconnected in a flow path of the refrigerant from the condenser to the first evaporator and the second evaporator, the method comprising:

performing a refrigerator cabinet cooling cycle comprising:

moving the valve to a first open state in which the condenser is fluidly connected to the first evaporator after a first time period of 10-80 seconds, switching the compressor on, and, after a second time period, switching the compressor off and moving the valve to a closed state; and performing a freezer cabinet cooling cycle, after the refrigerator cabinet cooling cycle, comprising:

moving the valve to a second open state in which the condenser is fluidly connected to the second evaporator, after a third time period, switching the compressor on, and after a fourth time period, switching the compressor off and moving the valve to the closed state.

9. The method of claim 8, wherein, during the refrigerator cabinet cooling cycle, the method further comprises moving the valve to the closed state before switching the compressor off.

10. A cooling system comprising:

a compressor;

a condenser;

an evaporator system fluidly connected to the compressor and condenser, the evaporator system, compressor and condenser being configured to contain a refrigerant for circulation therethrough;

a valve fluidly interconnected between the condenser and the evaporator system; and a controller operatively connected to the valve and configured to move the valve between a first, open, state when the compressor is in an on-phase and a second, closed, state when the compressor is in an off state, wherein the controller is adapted to control the valve to open the valve a time period of 10-80 seconds before the compressor is switched to an on-phase;

wherein the controller is adapted to open the valve before the compressor is switched to an on-phase, and wherein the time period is set to a time corresponding to a time required for all liquid refrigerant to flow from the condenser to the evaporator before the compressor is switched to an on-phase.

* * * * *